US010732561B2

(12) United States Patent
Mashimo

(10) Patent No.: US 10,732,561 B2
(45) Date of Patent: Aug. 4, 2020

(54) IMAGE FORMING APPARATUS WHICH FORMS FEEDER IMAGE FOR FEEDING TONER TO CLEANER

(71) Applicant: FUJI XEROX CO., LTD., Tokyo (JP)

(72) Inventor: Yoshiya Mashimo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/285,224

(22) Filed: Feb. 26, 2019

(65) Prior Publication Data

US 2020/0103815 A1 Apr. 2, 2020

(30) Foreign Application Priority Data

Sep. 27, 2018 (JP) ..... 2018-182825

(51) Int. Cl.
*G03G 15/01* (2006.01)
*G03G 21/00* (2006.01)

(52) U.S. Cl.
CPC ..... *G03G 21/0011* (2013.01); *G03G 21/00* (2013.01); *G03G 2221/0089* (2013.01)

(58) Field of Classification Search
CPC ..... G03G 21/0011; G03G 2221/0089; G03G 21/0005; G03G 15/5041; G03G 15/5058; G03G 2215/0037; G03G 2215/00042; G03G 21/00
USPC ..... 399/346, 350, 49
See application file for complete search history.

(56) References Cited

U.S. PATENT DOCUMENTS 5,107,285 A * 4/1992 Hamada ..... G03G 21/0011 347/130
5,463,455 A * 10/1995 Pozniakas ..... G03G 21/0011 399/350
5,881,339 A * 3/1999 Yanagida ..... G03G 15/168 399/101
6,032,006 A * 2/2000 Yanagida ..... G03G 15/168 399/101
2008/0218786 A1* 9/2008 Maebashi ..... B41J 29/393 358/1.12
2012/0274986 A1* 11/2012 Harashima ..... H04N 1/60 358/3.21
2015/0153694 A1* 6/2015 Shirafuji ..... G03G 15/50 399/72
2018/0259893 A1* 9/2018 Kurosu ..... G03G 15/553

FOREIGN PATENT DOCUMENTS

JP H11119559 4/1999
JP 11231688 A * 8/1999
JP 2003156889 A * 5/2003
JP 2006195233 A * 7/2006
JP 2012123164 A * 6/2012
JP 2013072916 4/2013

* cited by examiner

*Primary Examiner* — Robert B Beatty
(74) *Attorney, Agent, or Firm* — JCIPRNET

(57) ABSTRACT

An image forming apparatus includes an image carrier, a cleaner, and a controller. The image carrier holds an image on a surface thereof. The cleaner cleans the surface of the image carrier. The controller forms, at timing at which a developer is fed to the cleaner, a feeder image that feeds the developer to the cleaner. The feeder image includes toner whose amount is smaller on a downstream side than on an upstream side in a travel direction of the image carrier.

14 Claims, 5 Drawing Sheets

IMAGE FORMING APPARATUS WHICH FORMS FEEDER IMAGE FOR FEEDING TONER TO CLEANER

CROSS-REFERENCE TO RELATED APPLICATIONS

This application is based on and claims priority under 35 USC 119 from Japanese Patent Application No. 2018-182825 filed Sep. 27, 2018.

BACKGROUND

(i) Technical Field

The present disclosure relates to an image forming apparatus.

(ii) Related Art

Japanese Patent Application Publication No. 2013-72916 (refer to paragraphs [0031] to [0034] and FIGS. 2 to 4) and No. 11-119559 (refer to paragraphs [0046] to [0052] and FIG. 10) disclose the technologies of an image forming apparatus, such as a copying machine, a printer, or a FAX machine, that feeds a developer having a width called a toner band to a cleaner to lubricate the cleaner.

Japanese Patent Application Publication No. 2013-72916 describes a technology of forming a toner band (50), while feeding toner with a high density to a portion of the toner band (50) that reaches a cleaning blade (17) earlier, and gradually reducing the amount of toner fed to the cleaning blade (17).

Japanese Patent Application Publication No. 11-119559 describes a technology of preventing rolling up of end portions of a cleaning blade (17e) and lubricating the center portion of the cleaning blade (17e) by forming, between image areas, linear toner feed lines in any of three areas separate in a belt width direction, the lines being drawn with a high density in the end portions, and the lines being drawn with a low density in the center portion.

SUMMARY

Aspects of non-limiting embodiments of the present disclosure relate to productivity improvement while a developer is prevented from passing by compared to the case where a highly dense image is formed first for lubrication of a cleaning member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus that includes an image carrier, a cleaner, and a controller. The image carrier holds an image on a surface thereof. The cleaner cleans the surface of the image carrier. The controller forms, at timing at which a developer is fed to the cleaner, a feeder image that feeds the developer to the cleaner. The feeder image includes toner whose amount is smaller on a downstream side than on an upstream side in a travel direction of the image carrier.

BRIEF DESCRIPTION OF THE DRAWINGS

Exemplary embodiments of the present disclosure will be described in detail based on the following figures, wherein:

FIG. 6A illustrates a toner band according to a modification example 1, FIG. 6B illustrates a toner band according to a modification example 2, and FIG. 6C illustrates a toner band according to a modification example 3: FIG. 7A illustrates a toner band according to a modification example 4, and FIG. 7B illustrates a toner band according to a modification example 5.

DETAILED DESCRIPTION

With reference to the drawings, specific examples (referred to as examples, below) of an exemplary embodiment of the present disclosure will be described. The present disclosure is not limited to the following examples.

For easy understanding of the following description, throughout the drawings, an X axis direction denotes the front-rear direction, a Y axis direction denotes the lateral direction, and a Z axis direction denotes the vertical direction. The directions or sides denoted with arrows X, −X, Y, −Y, Z, and −Z are respectively referred to as forward, rearward, rightward, leftward, upward, and downward, or a front side, a rear side, a right side, a left side, an upper side, and a lower side.

Throughout the drawings, an encircled dot denotes an arrow directing from the back to the front of the sheet, and an encircled cross denotes an arrow directing from the front to the back of the sheet.

In the description with reference to the drawings, components other than those needed for the description are appropriately omitted for ease of understanding.

Example 1

Figure 1:
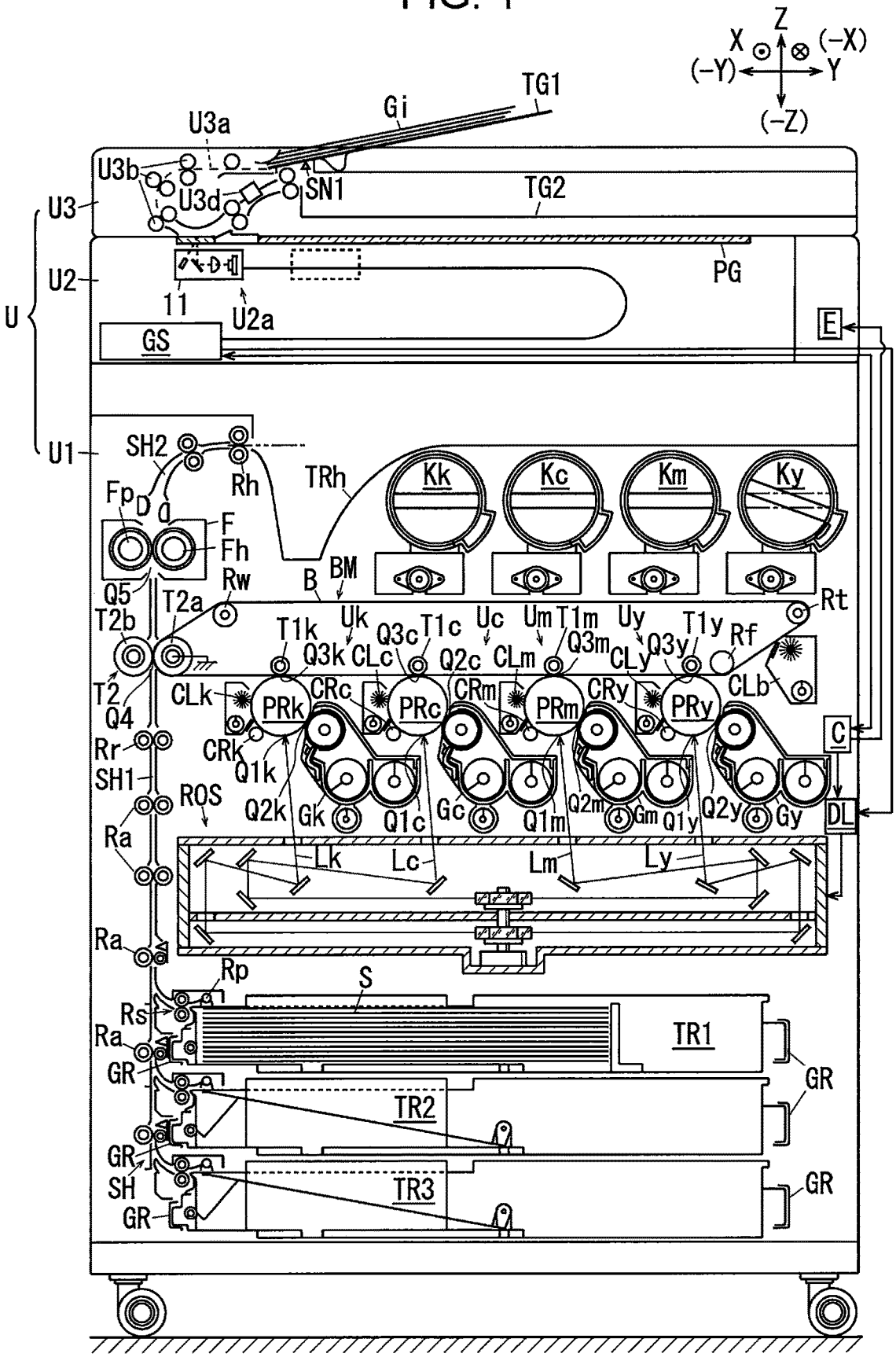
FIG. 1 illustrates the entirety of an image forming apparatus according to an example 1.

FIG. 1 illustrates the entirety of an image forming apparatus according to an example 1.

In FIG. 1, a copying machine U, which is an example of an image forming apparatus according to the example 1 of the present disclosure, includes a printer unit U1, which is an example of a recording unit and an example of an image recording device. The printer unit U1 supports, on its upper side, a scanner unit U2, which is an example of a reading unit and an example of an image reading device. The scanner unit U2 supports, on its upper side, an auto-feeder U3, which is an example of a document transporting device.

The auto-feeder U3 includes, at an upper portion, a document tray TG1, which is an example of a medium accommodating member. The document tray TG1 is capable of accommodating a stack of multiple documents Gi that are to be copied. A document output tray TG2, which is an example of a document discharge portion, is disposed below the document tray TG1. Document transport rollers U3*b* are disposed along a document transport path U3*a* connecting the document tray TG1 and the document output tray TG2.

On the upper surface of the scanner unit U2, a platen glass PG, which is an example of a transparent document table, is disposed. The scanner unit U2 according to the example 1 includes a reading unit U2*a*, which is an example of the reading unit, under the platen glass PG. The reading unit U2*a* according to the example 1 is supported to be movable in the lateral direction, which is an example of a sub-scanning direction, along the lower surface of the platen glass PG. The reading unit U2*a* is stationary in a normal state in an initial position drawn with a solid line in FIG. 1. The reading unit U2*a* is electrically connected to an image processor GS.

The auto-feeder U3 according to the example 1 includes a read sensor U3*d*, which is an example of a second reading portion, on the document transport path U3*a* downstream, in a document transport direction, of a portion facing the reading unit U2*a*. The read sensor U3*d* is capable of reading the surface of a document Gi opposite to the surface facing the reading unit U2*a*.

Figure 2:
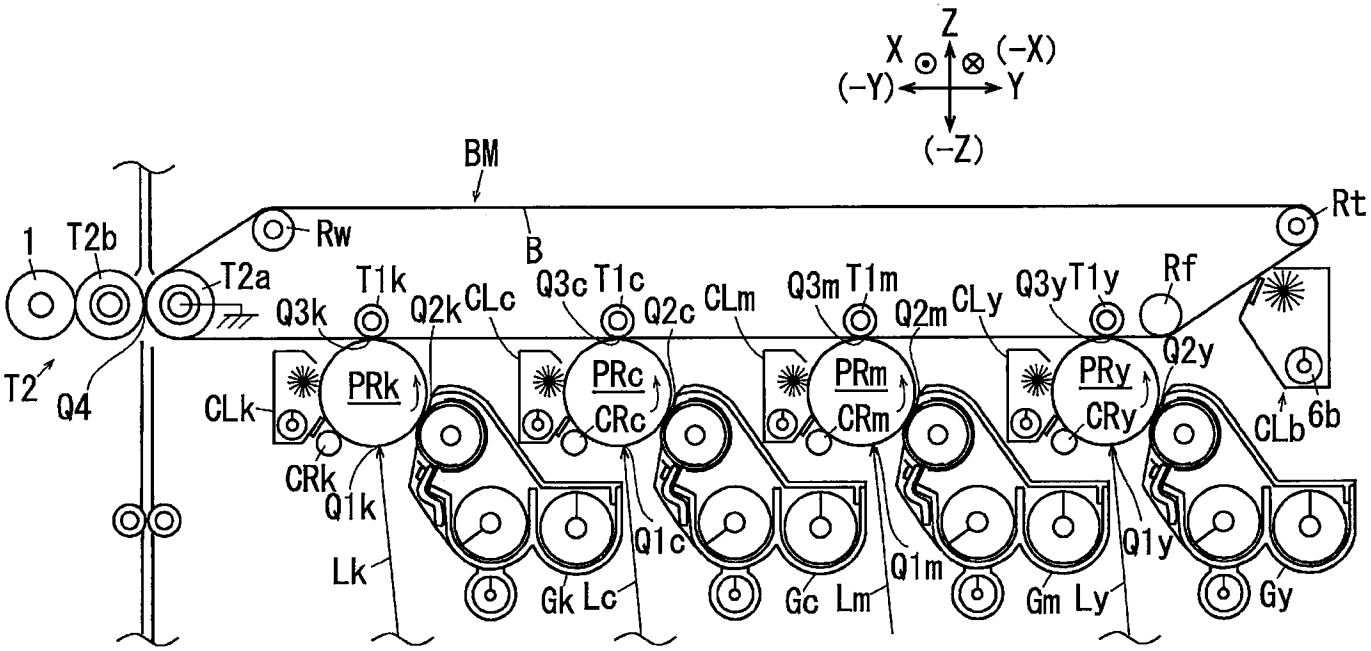
FIG. 2 illustrates a related portion of an image recording unit according to the example 1.

FIG. 2 illustrates a related portion of an image recording unit according to the example 1.

The image processor GS is electrically connected to a write circuit DL of the printer unit U1. The write circuit DL is electrically connected to an exposure device ROS, which is an example of a latent image forming member.

The exposure device ROS according to the example 1 is capable of outputting laser beams Ly, Lm, Lc, and Lk, corresponding to the colors Y, M, C, and K, which are examples of write light. The exposure device ROS is capable of outputting the laser beams Ly to Lk corresponding to signals input from the write circuit DL.

The write circuit DL or a power circuit E has write timing or power feed timing controlled in accordance with control signals from a controller C, which is an example of a controller.

In FIG. 1, photoconductors PRy, PRm, PRc, and PRk, which are an example of an image carrier, are disposed above the exposure device ROS. In FIGS. 1 and 2, the areas of the photoconductors PRy to PRk respectively irradiated with the laser beams Ly to Lk constitute write areas Q1*y*, Q1*m*, Q1*c*, and Q1*k*.

Upstream of the write areas Q1*y* to Q1*k* in the rotation direction of the photoconductors PRy, PRm, PRc, and PRk, charging rollers CRy, CRm, CRc, and CRk, which are an example of a charging member, are disposed. The charging rollers CRy to CRk according to the example 1 are supported to be driven to rotate by and in contact with the photoconductors PRy to PRk.

Downstream of the write areas Q1*y* to Q1*k* in the rotation direction of the photoconductors PRy to PRk, developing devices Gy, Gm, Gc, and Gk, which are an example of a developing member, are disposed. The areas over which the photoconductors PRy to PRk and the developing devices Gy to Gk face each other constitute development areas Q2*y*, Q2*m*, Q2*c*, and Q2*k*.

Downstream of the developing devices Gy to Gk in the rotation direction of the photoconductors PRy to PRk, first transfer rollers T1*y*, T1*m*, T1*c*, and T1*k*, which are an example of a first transfer member, are disposed. The areas over which the photoconductors PRy to PRk and the first transfer rollers T1*y* to T1*k* face each other constitute first transfer areas Q3*y*, Q3*m*, Q3*c*, and Q3*k*.

Downstream of the first transfer rollers T1*y* to T1*k* in the rotation direction of the photoconductors PRy to PRk, photoconductor cleaners CLy, CLm, CLc, and CLk, which are an example of a cleaner, are disposed.

The photoconductor PRy, the charging roller CRy, the exposure device ROS that outputs the laser beam Ly for the color Y, the developing device Gy, the first transfer roller T1*y*, and the photoconductor cleaner CLy for the color Y constitute an image forming unit Uy for the color Y, which is an example of a visible image forming member for the color Y according to the example 1 that forms toner images. Similarly, the photoconductors PRm, PRc, and PRk, the charging rollers CRm, CRc, and CRk, the exposure device ROS, the developing devices Gm, Gc, and Gk, the first transfer rollers T1*m*, T1*c*, and T1*k*, and the photoconductor cleaners CLm, CLc, and CLk constitute image forming units Um, Uc, and Uk for the colors M, C, and K.

Above the photoconductors PRy to PRk, a belt module BM, which is an example of an intermediate transfer device, is disposed. The belt module BM is an example of an image carrier, and includes an intermediate transfer belt B, which is an example of an intermediate transfer member. The intermediate transfer belt B is formed from an endless belt member.

The intermediate transfer belt B according to the example 1 is rotatably supported by a tension roller Rt, which is an example of a tension member, a walking roller Rw, which is an example of an imbalance correcting member, an idler roller Rf, which is an example of a driven member, a backup roller T2*a*, which is an example of a member opposing the second transfer area, and the first transfer rollers T1*y*, T1*m*, T1*c*, and T1*k*. In the example 1, the intermediate transfer belt B rotates when the backup roller T2*a*, which is an example of a driving member, receives a driving force.

At the position opposing the backup roller T2*a* across the intermediate transfer belt B, a second transfer roller T2*b*, which is an example of a second transfer member, is disposed. The backup roller T2*a*, the second transfer roller T2*b*, and other components constitute a second transfer device T2 according to the example 1, which is an example of a transfer device. The area over which the second transfer roller T2*b* and the intermediate transfer belt B come into contact with each other constitutes a second transfer area Q4.

Downstream of the second transfer area Q4 in the rotation direction of the intermediate transfer belt B, a belt cleaner CLb, which is an example of a device for cleaning an intermediate transfer body, is disposed.

The first transfer rollers T1*y* to T1*k*, the intermediate transfer belt B, the second transfer device T2, and other components constitute a transfer device T1+T2+B according to the example 1, which is an example of a transfer member. The image forming units Uy to Uk and the transfer device T1+T2+B constitute an image recording unit Uy+Um+Uc+Uk+T1+T2+B according to the example 1.

In FIG. 1, below the image forming units Uy to Uk, three pairs of left and right guide rails GR, which are an example of a guide member, are disposed. Each guide rail GR is supported while allowing a corresponding one of sheet feed trays TR1 to TR3, which are an example of a medium accommodating member, to be inserted thereinto or removed therefrom in the front-rear direction. The sheet feed trays TR1 to TR3 accommodate recording sheets S, which are an example of a medium.

On the upper left of each of the sheet feed trays TR1 to TR3, a pickup roller Rp, which is an example of a pickup member, is disposed. Downstream of the pickup roller Rp in the transport direction of the recording sheets S, separation rollers Rs, which are an example of a separation member, are disposed. Downstream of the separation rollers Rs in the transport direction of the recording sheets S, a sheet feed path SH1, which is an example of a medium transport path, extends upward. On the sheet feed path SH1, multiple transport rollers Ra, which are an example of a transport member, are disposed.

Upstream of the second transfer area Q4 on the sheet feed path SH1, registration rollers Rr, which are an example of a member for adjusting transport timing, are disposed.

Downstream of the second transfer area Q4 in the transport direction of the recording sheets S, a fixing device F, which is an example of a fixing member, is disposed. The fixing device F includes a heating roller Fh, which is an example of a heating fixing member, and a pressing roller Fp, which is an example of a pressing fixing member. The area over which the heating roller Fh and the pressing roller Fp come into contact with each other constitutes a fixing area Q5.

Above the fixing device F, a paper output path SH2, which is an example of a transport path, is disposed. On the upper surface of the printer unit U1, a paper output tray TRh, which is an example of a medium output portion, is disposed. The paper output path SH2 extends toward the paper output tray TRh. At the downstream end of the paper output path SH2, output rollers Rh, which are an example of a medium transport member, are disposed.

Description of Image Forming Operation

When an operator manually places a document Gi on the platen glass PG of the copying machine U according to the example 1 having the above structure for photocopying, the reading unit U2*a* moves in the lateral direction from the initial position to scan the document Gi on the platen glass PG while exposing the document Gi to light. When the auto-feeder U3 is used to automatically transport the documents Gi for photocopying, the reading unit U2*a* moves from the initial position to a document read position, indicated with a broken line in FIG. 1, and remains stationary. Thereafter, the multiple documents Gi accommodated in the document tray TG1 are sequentially transported to the document read position on the platen glass PG, and then passes the document read position to be discharged onto the document output tray TG2. The documents Gi that sequentially pass the read position on the platen glass PG are exposed to light and scanned by the stationary reading unit U2*a*. Light reflected off the documents Gi is received by the reading unit U2*a*. The reading unit U2*a* converts the received light reflected off the documents Gi into electric signals. To perform double-sided reading of a document Gi, the read sensor U3*d* also reads the document Gi.

The image processor GS receives electric signals output from the reading unit U2*a*. The image processor GS converts the electric signals of images of the colors R, G, and B read by the reading unit U2*a* into image information of yellow Y, magenta M, cyan C, and black K for latent image formation. The image processor GS outputs the converted image information to the write circuit DL of the printer unit U1. The image processor GS outputs the image information for only black K to the write circuit DL when an image is a single-color image, or a monochrome image.

The write circuit DL outputs control signals corresponding to the input image information to the exposure device ROS. The exposure device ROS outputs the laser beams Ly to Lk corresponding to the control signals.

The photoconductors PRy to PRk rotate in response to the start of image formation. The charging rollers CRy to CRk receive a charging voltage from the power circuit E. Thus, the photoconductors PRy to PRk have their surfaces electrically charged by the charging rollers CRy to CRk. Electrostatic latent images are formed in the write areas Q1*y* to Q1*k* on the surfaces of the electrically charged photoconductors PRy to PRk with the laser beams Ly to Lk. The electrostatic latent images on the photoconductors PRy to PRk are developed into toner images, which are an example of a visible image, by the developing devices Gy, Gm, Gc, and Gk in the development areas Q2*y* to Q2*k*.

The developed toner images are transported to the first transfer areas Q3*y*, Q3*m*, Q3*c*, and Q3*k*, at which they come into contact with the intermediate transfer belt B, which is an example of an intermediate transfer body. In the first transfer areas Q3*y*, Q3*m*, Q3*c*, and Q3*k*, the first transfer rollers T1*y* to T1*k* receive, from the power circuit E, a first transfer voltage having a polarity opposite to the polarity with which the toner is charged. Thus, the toner images on the photoconductors PRy to PRk are transferred to the intermediate transfer belt B by the first transfer rollers T1*y* to T1*k*. To form a multi-color toner image, a toner image on the downstream side is transferred to the intermediate transfer belt B to be superposed on a toner image that has been transferred to the intermediate transfer belt B in the upstream first transfer area.

Remnants or deposits left on the photoconductors PRy to PRk after a first transfer are respectively removed by the photoconductor cleaners CLy to CLk. The surfaces of the cleaned photoconductors PRy to PRk are respectively electrically recharged by the charging rollers CRy to CRk.

Single-color or multi-color toner images transferred onto the intermediate transfer belt B by the first transfer rollers T1*y* to T1*k* in the first transfer area Q3*y* to Q3*k* are transported to the second transfer area Q4.

Recording sheets S on which images are to be recorded are picked up by the pickup roller Rp of an appropriate one of the sheet feed trays TR1 to TR3. The recording sheets S picked up by the pickup roller Rp while being stacked together are separated one from another by the separation rollers Rs. The recording sheets S separated by the separation rollers Rs are transported along the sheet feed path SH1 by the transport rollers Ra. The recording sheets S transported along the sheet feed path SH1 are fed to the registration rollers Rr.

The registration rollers Rr transport a recording sheet S to the second transfer area Q4 at the timing when a toner image formed on the intermediate transfer belt B is transported to the second transfer area Q4. The second transfer roller T2*b* receives, from the power circuit E, a second transfer voltage having a polarity opposite to the polarity with which toner is charged. Thus, the toner image on the intermediate transfer belt B is transferred to the recording sheet S from the intermediate transfer belt B.

After the second transfer, the intermediate transfer belt B is cleaned by the belt cleaner CLb to remove deposits or other matters adhering to the surface.

The recording sheets S to which the toner image has been second-transferred is heated to have the toner image fixed while passing the fixing area Q5.

The recording sheet S having an image fixed thereto is transported along the paper output path SH2. The recording sheet S transported along the paper output path SH2 is discharged to the paper output tray TRh by the output rollers Rh.

Figure 3:
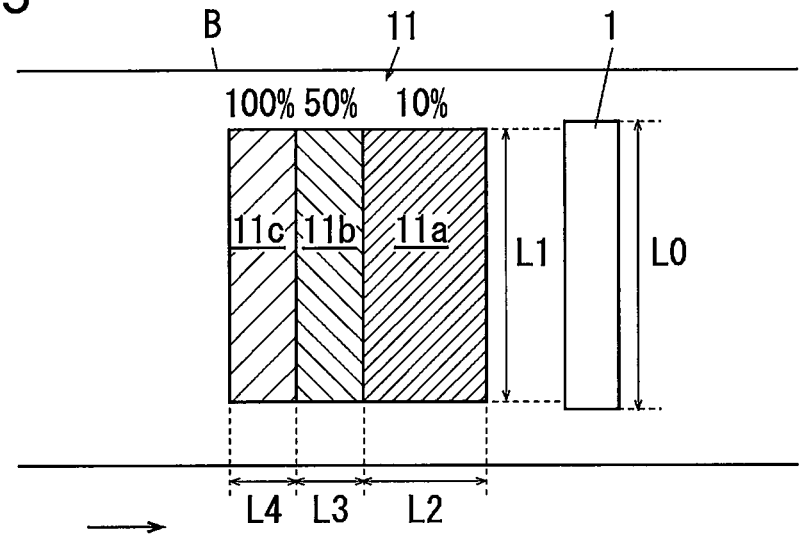
FIG. 3 illustrates a toner band and a cleaning member according to the example 1.

FIG. 3 illustrates a toner band and a cleaning member according to the example 1.

Figure 4:
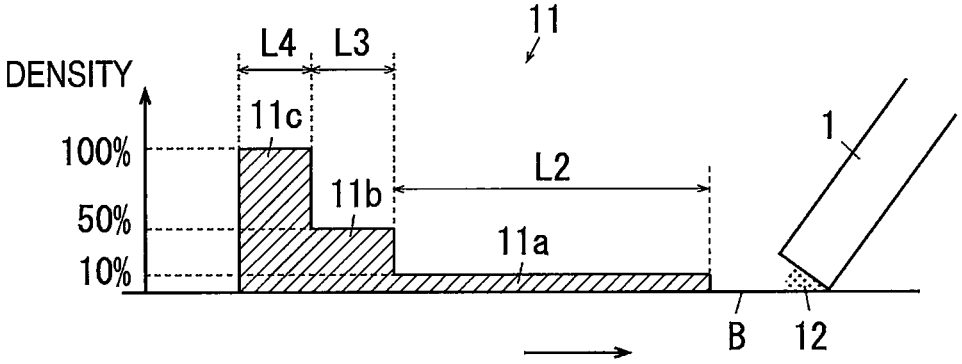
FIG. 4 illustrates the density of a toner band.

FIG. 4 illustrates the density of a toner band.

In FIG. 3, the belt cleaner CLb includes a cleaning blade 1, which is an example of a cleaner. In FIGS. 3 and 4, in the example 1, the controller C controls to form a toner band 11, which is an example of a feeder image, on the intermediate transfer belt B at timing to form a predetermined toner band. The toner band 11 is formed in a belt shape (band shape) extending from a first end to a second end of the width of the cleaning blade 1. In the example 1, the toner band 11 is formed from, for example, a developer of the color K. Here, the toner band 11 is an image formed, separate from a user image, on each of the photoconductors PRy to PRk to eject the developer determined to be deteriorated from the developing devices Gy to Gk (image formed with toner of the developer determined to be deteriorated) Preferably, the density of the latent images (input area coverage) on the surfaces of the photoconductors PRy to PRk that form the bases of the toner bands is substantially uniform in the process direction (in the direction in which the toner bands are formed on the photoconductors PRy to PRk).

The time when every predetermined number of sheets are printed, for example, the time when every 100 sheets are printed may be determined to be the time to form a toner band. Alternatively, for example, the time when the copying machine U is turned on, a predetermined time point, or the time when a job is started may be automatically determined to be the time to form a toner band. Alternatively, an operator may manually set the time to form a toner band, or the time to form a toner band may be instructed through an input operation. In addition, the elapse of a certain period of time for which the amount of the developer fed to the cleaning blade 1 is insufficient may be determined to be the time to form a toner band. For example, the time when the average density falls below a predetermined density, that is, the amount of the developer that reaches the cleaning blade 1 is insufficient may be determined to be the time to form a toner band, where the average density is calculated from the accumulated number of printed sheets and the accumulated amount of consumption of the developer, calculated from the image density at the image formation.

In FIG. 3, in the example 1, a width L1 of the toner band 11 is slightly shorter than a width L0 of the cleaning blade 1. Thus, the toner band 11 has such a width that both ends of the toner band 11 are disposed to the inner side of both ends of the cleaning blade 1.

In FIGS. 3 and 4, the toner band 11 according to the example 1 has a front portion 11*a*, a middle portion 11*b*, and a rear portion 11*c* in the travel direction of the intermediate transfer belt B. The front portion 11*a*, the middle portion lib, and the rear portion 11*c* differ in density. The front portion 11*a* has a low density. The rear portion 11*c* has a higher density than the front portion 11*a*. The middle portion 11*b* has a density higher than that of the front portion 11*a*, and lower than that of the rear portion 11*c*. For example, the density of the front portion 11*a* is set to 10%, the density of the middle portion 11*b* is set to 50%, and the density of the rear portion 11*c* is set to 100%.

In the example 1, a length L2 of the front portion 11*a* in the travel direction of the intermediate transfer belt B is set to a length based on the time taken for the cleaning blade 1 to recover its cleaning performance. That is, the time taken from the state where the developer is insufficient in an area 12 between the cleaning blade 1 and the intermediate transfer belt B until the cleaning blade 1 recovers its cleaning performance through lubrication with the fed developer has been calculated in advance through, for example, an experiment. The length L2 of the toner band 11 is set based on the period (time taken for the cleaning blade 1 to recover its cleaning performance).

A length L4 of the rear portion 11*c* in the travel direction of the intermediate transfer belt B is set as the length in the travel direction of the intermediate transfer belt B based on the amount of the developer accumulated in the contact area 12 between the cleaning blade 1 and the intermediate transfer belt B. Specifically, when the toner band 11 is removed with the cleaning blade 1, part of the developer is left to accumulate in the area 12. A so-called toner dam is formed. The developer remaining in the toner dam (mainly, additives contained in the developer) lubricates the cleaning blade 1 and the intermediate transfer belt B. Thus, the amount of the developer capable of lubricating for a predetermined period has been determined in advance through, for example, an experiment, and the length L4 of the rear portion 11*c* of the toner band 11 is set such that a sufficiently large amount of developer is allowed to be fed to accumulate.

A length L3 of the middle portion 11*b* may be set to any length that compensates for a sudden change of the density from the front portion 11*a* having a low density to the rear portion 11*c* having a high density. In the example 1, for example, L3=L4.

Effects of Example 1

Figure 5:
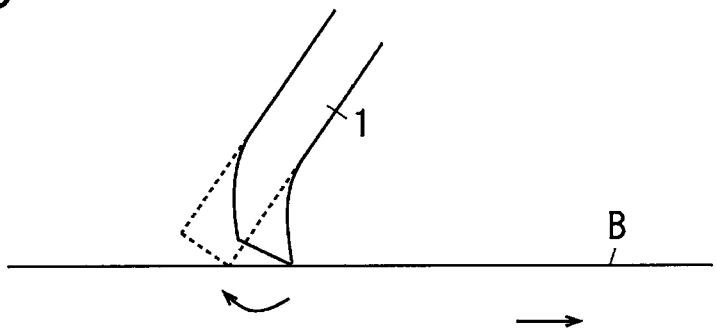
FIG. 5 illustrates an operation according to the example 1.

FIG. 5 illustrates effects of the example 1.

In the copying machine U according to the example 1 having the above structure, the cleaning blade 1, which cleans the intermediate transfer belt B in image formation, may curl up, as drawn with a solid line in FIG. 5, with a rotation of the intermediate transfer belt B, if the amount of the developer is insufficient due to, for example, continued image formation with a low density, and the frictional force between the cleaning blade 1 and the intermediate transfer belt B increases. The deformed cleaning blade 1 degrades its cleaning performance, so that the developer may pass by the cleaning blade 1 and is more likely to adversely affect the image quality.

When a toner band is formed to feed the developer to the cleaning blade 1, the developer serves as a lubricant and reduces the frictional force between the cleaning blade 1 and the intermediate transfer belt B. Thus, the cleaning blade 1 restores elastically, as indicated with the broken line in FIG. 5. If, as in Japanese Patent Application Publication No. 2013-72916 (refer to paragraphs [0031] to and FIGS. 2 to 4) and No. 11-119559 (refer to paragraphs [0046] to [0052] and FIG. 10), a large amount of the developer is fed all at once in the form of a toner band, the frictional force suddenly decreases, and the cleaning blade 1 suddenly restores elastically. The sudden elastic restoration of the cleaning blade 1 causes a spring movement. Thus, at the sudden elastic restoration, the intermediate transfer belt B may pass by the cleaning blade 1 without having its surface fully cleaned with the cleaning blade 1, so that the developer may remain.

In the example 1, on the other hand, the toner band 11 has a low density at the front portion 11*a* to prevent sharp reduction of the frictional force when the front portion 11*a* comes into contact with the cleaning blade 1. Thus, compared to the structures described in Japanese Patent Application Publication No. 2013-72916 (refer to paragraphs [0031] to [0034] and FIGS. 2 to 4) and No. 11-119559 (refer to paragraphs [0046] to [0052] and FIG. 10), the cleaning blade 1 is less likely to suddenly restore elastically, and more likely to restore elastically while cleaning the intermediate transfer belt B. Thus, the example 1 more efficiently prevents the developer from passing by than in the case where an image with a high density is formed first for lubricating the cleaning blade 1.

Particularly, in the example 1, the length L2 of the front portion 11*a* in the belt rotation direction is set based on the time taken for the cleaning blade 1 to recover its cleaning performance. This structure prevents the rear portion 11*c* from reaching the cleaning blade 1 before the cleaning blade 1 completely recovers its cleaning performance, that is, completely restores elastically, and prevents the developer from passing by.

In the example 1, the rear portion 11*c* is formed from an image with a high density. It would take a long time to accumulate a predetermined amount of the developer in a toner dam if the middle portion 11*b* and the rear portion 11*c* are formed with images with a low density. Thus, it would take a long time to form the toner band 11 or perform other operations. In contrast, in the example 1, the rear portion is formed from an image with a high density, so that a predetermined amount of the developer accumulates in the toner dam more quickly. This structure reduces the time taken to form a toner band, and is less likely to adversely affect an image formation operation. This structure thus improves productivity compared to the case where the rear portion 11*c* is formed from a toner band with a low density.

Particularly, in the example 1, the length L4 of the rear portion 11*c* is set based on the amount of the toner dam. This structure prevents shortage of the amount of the toner dam. This structure thus prevents quick consumption of the developer in the toner dam and keeps the cleaning blade clean for a long term.

In the example 1, the middle portion 11*b* is set to have a middle density. This structure prevents the developer from passing by, unlike in the case where the density is suddenly changed from the low density in the front portion 11*a* to the high density in the rear portion 11*c*, in which part of the developer may pass by without being fully removed in cleaning in an insufficient period or in which the cleaning blade 1 insufficiently restores elastically only at the front portion 11*a*.

The toner band 11 according to the example 1 is formed almost throughout in the width direction of the cleaning blade 1. Thus, the cleaning blade 1 may be lubricated throughout in the width direction. Both ends of the toner band 11 in the width direction are located to the inner side of both ends of the cleaning blade 1. This structure thus prevents both ends of the toner band 11 from being left without being removed by the cleaning blade 1, unlike in the case where the toner band 11 is wider than the cleaning blade 1.

Modification Example 1

Figure 6A:
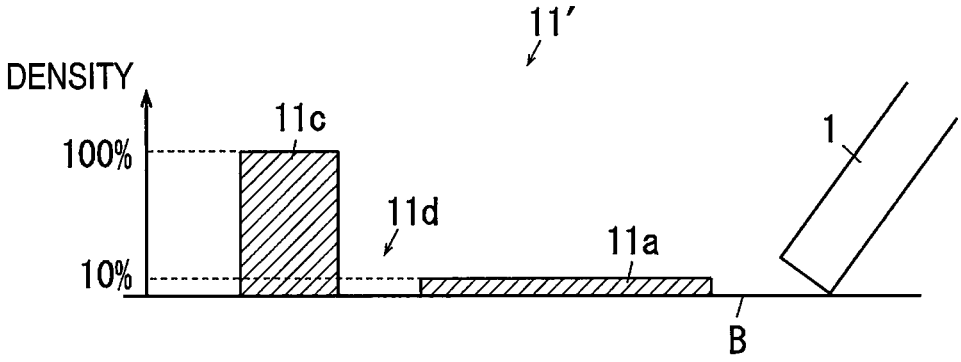
FIGS. 6A to 6C illustrate modification examples of the example 1, where
Figure 6B:
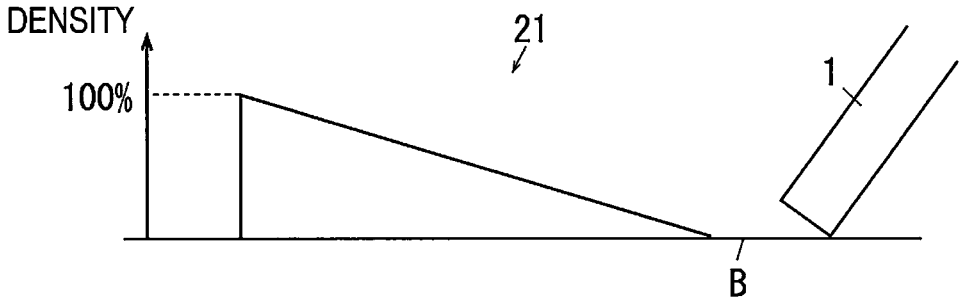
Figure 6C:
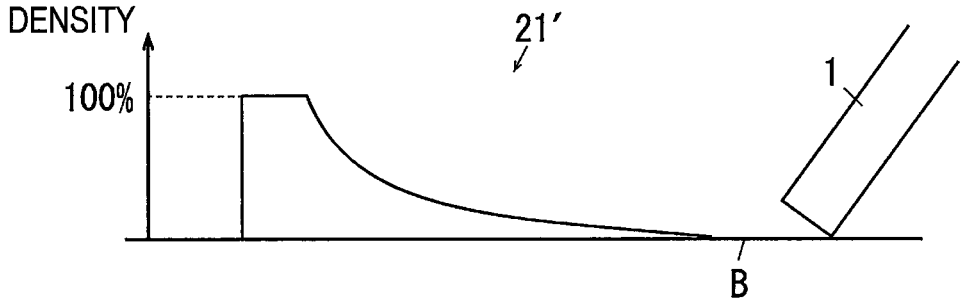

FIGS. 6A to 6C illustrate modification examples of the example 1, where FIG. 6A illustrates a toner band according to a modification example 1, FIG. 6B illustrates a toner band according to a modification example 2, and FIG. 6C illustrates a toner band according to a modification example 3.

In the example 1, a structure in which the toner band 11 includes the middle portion lib is described as an example. This is not the only possible structure, however. For example, the rear portion 11*c* may be disposed continuous with the front portion 11*a*. Instead, as illustrated in FIG. 6A, the structure may include a toner band 11' in which the rear portion 11*c* is spaced apart from the front portion 11*a* with a gap 11*d* interposed therebetween.

Also in the structure illustrated in FIG. 6A, after the developer constituting the front portion 11*a* is fed to the contact area 12 of the cleaning blade 1, the developer in the contact area 12 lubricates with the elapse of time without the developer being fed to the gap 11*d* of the toner band, so that the cleaning blade 1 restores elastically. Thus, the toner band 11' having the gap 11*d* also has the same effect as the example 1. This structure also reduces the amount of consumption of the developer compared to the toner band 11 according to the example 1.

Modification Examples 2 and 3

In the toner band 11 according to the example 1, the density is changed stepwise between the front portion 11*a*, the middle portion 11*b*, and the rear portion 11*c*. This structure is not the only possible structure, however. For example, as illustrated in FIG. 6B, the structure may include a toner band 21 in which the density is gradually changed. Alternatively, as illustrated in FIG. 6C, the structure may include a toner band 21' in which the density increases continuously and exponentially.

Modification Example 4

Figure 7A:
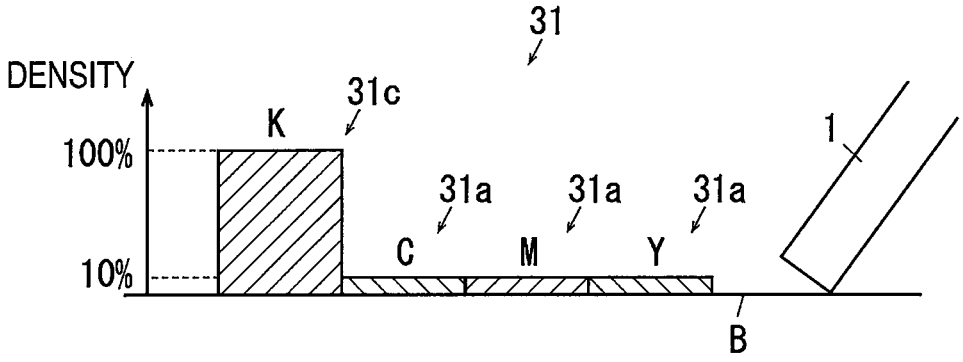
FIGS. 7A and 7B illustrate modification examples of the example 1, where
Figure 7B:
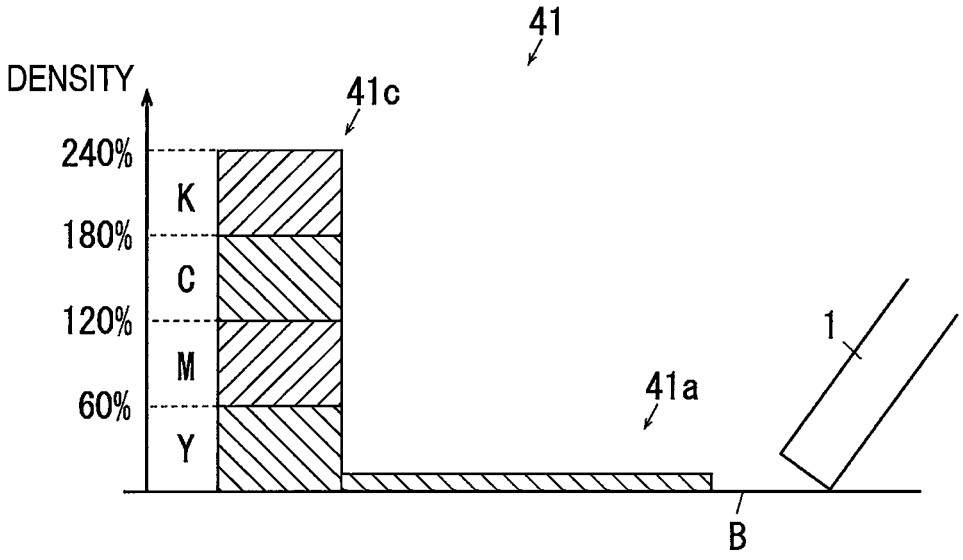

FIGS. 7A and 7B illustrate modification examples of the example 1, where FIG. 7A illustrates a toner band according to a modification example 4, and FIG. 7B illustrates a toner band according to a modification example 5.

In the toner band 11 according to the example 1, a structure in which the toner band 11 is formed with a developer of the color K, used highly frequently and less costly, is described as an example. This is not the only possible structure, however. As illustrated in FIG. 7A, the structure may include a toner band 31, in which, for example, the front portion 31*a* is formed from developers of the colors Y, M, and C, and the rear portion 31*c* is formed from a developer of the color K.

FIG. 7A illustrates, for example, a case where the front portion 31*a* is formed from the developers with three colors and the rear portion 31*c* is formed from the developer with a single color. This is not the only possible structure, however. The front portion 31*a* may be formed from only the developer of the color Y or developers of the colors Y and M with a low density, and the rear portion 31*c* may be formed from the developers of the colors C and K or developers of the colors M, C, and K with a high density.

Alternatively, the amount of consumption of the developers of the respective colors from the formation of the previous toner band 31 to the formation of the subsequent toner band 31 may be calculated, and the rear portion 31*c*, which consumes the largest amount of the developer, may be formed with the developer of the color whose amount of consumption is least, that is, that degrades most (that is least consumed) to discharge the degraded developer from the developing devices Gy to Gk. In this structure, development with a degraded developer is prevented, so that the degradation of the image quality is prevented. In accordance with the degree of degradation of the developer (the amount of total consumption), the color of the developer for forming the front portion 31*a* may be switched with the color of the developer for forming the rear portion 31*c* according to the situation so that the front portion 31*a* is formed with the developer of the color that degrades least and the rear portion 31*c* is formed with the developer of the color that degrades most. Thus, the degraded developer is allowed to be discharged without delay. The density of each area of the toner band 31 may be adjusted, increased or reduced, in accordance with the degree of degradation of the developer of each color.

Alternatively, the front portion 31*a* may be formed from the developer of the color less perceptible by human eyes, that is, unnoticeable, when printed. For example, the developer with the color M or K even with a low density is perceptible or noticeable by human eyes, but the developer with the color Y or C with a low density is unnoticeable even when attached to a white sheet. Here, the developer constituting the front portion 31*a* has a low density and is less likely to pass by the cleaning blade 1, but may partially pass by when the cleaning blade 1 restores elastically. In such a case, a developer with an unnoticeable color that passes by is less likely to cause degradation of an image quality even when adhering to the sheet, compared to the case where the developer of a noticeable color passes by. Thus, forming the front portion 31*a* with a developer with an unnoticeable color is preferable.

To prevent the developer constituting the front portion 31*a* from passing by, the front portion 31*a* may be formed from the developer with an easily cleanable color. Generally, the developer with a smaller grain size more easily passes by the cleaning blade 1, and the developer with a larger grain size is easily removable. The developer having a shape closer to a sphere (polymerized toner) is less easily removable than the developer having a distorted shape (grinded toner). Thus, when the developers of the colors Y, M, C, and K include developers having the largest grain size or polymerized toner and grinded toner, the developer with the color of grinded toner is less likely to pass by when forming the front portion 31*a*, so that the degradation of the image quality is reduced.

Modification Example 5

In addition, as illustrated with a toner band 41 in FIG. 7B, a rear portion 41*c* may be formed with a stack of the developers of four colors. This structure prevents a specific color from being intensively consumed, and enables a large amount of the developers to be fed to the cleaning blade 1 at once, compared to the case where the rear portion 41*c* is formed from the developer of a single color.

A front portion 41*a* may be formed with a stack of the developers with four colors, or with a developer that degrades most. In this case, the developer of the color that degrades most is consumed at both the front portion 41*a* and the rear portion 41*c*. Thus, a larger amount of the degraded developer is consumed compared to the case where the degraded developer is consumed at only the rear portion 41*c*.

Alternatively, the front portion 41*a* may be formed with a stack of the developers of two to four colors, or formed with a developer with an unnoticeable or easily cleanable color, as described in the modification example 4.

Modification Examples

Thus far, the examples of the present disclosure have been descried in detail. However, the disclosure is not limited to the above-described examples, and may be modified in various manners within the scope of the gist of the present disclosure described in the scope of claims. Modified examples H01 to H04 of the present disclosure are described, below, by way of examples.

H01

In the above examples, the copying machine U has been described as an example of an image forming apparatus. The present disclosure is not limited to this, however. The image forming apparatus is applicable to a FAX machine, or a multifunctional printer having multiple functions such as a FAX machine, a printer, and a copying machine. The image forming apparatus is not limited to an electrophotographic image forming apparatus, and is applicable to an image forming apparatus of any image forming form such as ink jet printing, or photolithographic printing including thermal head printing. In addition, the image forming apparatus is not limited to an image forming apparatus for multi-color development, and may be an image forming apparatus for forming single-color or monochrome images.

H02

In the above-described examples, a toner band formed on the belt cleaner CLb has been described. However, toner bands may be similarly formed on the photoconductor cleaners CLy to CLk of the photoconductors PRy to PRk.

H03

In the above-described examples, specific numerical values described as examples are appropriately changeable in accordance with, for example, the design or specifications.

H04

In the above-described examples, preferably, the width L0 of the cleaning blade 1 and the width L1 of the toner band 11 have the above-described relationship. This is not the only possible structure, however. Instead, the relationship may be L0<L1.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus, comprising:

an image carrier that holds an image on a surface thereof;

a cleaner that cleans the surface of the image carrier; and a controller that forms, at a timing at which a toner is fed to the cleaner, a feeder image that feeds the toner to the cleaner, the feeder image including the toner, wherein the feeder image includes a front portion and a rear portion in a travel direction of the image carrier, wherein a density of toner of the rear portion is greater than a density of toner of the front portion, wherein a length of the front portion in the travel direction is greater than a length of the rear portion in the travel direction.

2. The image forming apparatus according to claim 1, wherein the feeder image extends in a width direction of the cleaner perpendicular to the travel direction of the image carrier.

3. The image forming apparatus according to claim 2, wherein both ends of the feeder image are located to an inner side, in the width direction, of both ends of the cleaner.

4. The image forming apparatus according to claim 1, wherein the front portion and the rear portion are spaced apart from each other with a gap interposed therebetween.

5. The image forming apparatus according to claim 1, wherein a middle portion is formed between the rear portion and the front portion in the travel direction of the image carrier, and a density of toner of the middle portion is smaller than that of the rear portion and larger than that of the front portion.

6. The image forming apparatus according to claim 1,
wherein a density of toner of the feeder image is uniform in a width direction of the cleaner perpendicular to the travel direction of the image carrier.

7. An image forming apparatus, comprising:
an image carrier that holds an image on a surface thereof; and
a cleaner that cleans the surface of the image carrier,
wherein at a timing at which a toner is fed to the cleaner, a feeder image including the toner is formed,
wherein the feeder image includes a front portion and a rear portion in a travel direction of the image carrier,
wherein a density of toner of the rear portion is greater than a density of toner of the front portion,
wherein a length of the front portion in the travel direction is greater than a length of the rear portion in the travel direction.

8. An image forming apparatus, comprising:
an image carrier that holds an image on a surface thereof;
a cleaner that cleans the surface of the image carrier;
a controller that forms, at a timing at which a toner is fed to the cleaner, a feeder image that feeds the toner to the cleaner, the feeder image including the toner, and
a plurality of developing members that accommodate different color toners,
wherein the image carrier is formed from an intermediate transfer member that holds images developed by the plurality of developing members, and the plurality of developing members form a single feeder image,
wherein the feeder image includes a front portion and a rear portion in a travel direction of the image carrier,
wherein a density of toner of the rear portion is greater than a density of toner of the front portion,
wherein a length of the front portion in the travel direction is greater than a length of the rear portion in the travel direction.

9. The image forming apparatus according to claim 8,
wherein the different color toners that respectively form the rear portion and the front portion of the feeder image are switchable.

10. The image forming apparatus according to claim 9,
wherein the rear portion of the feeder image includes a stack of all the images developed by the plurality of developing members.

11. The image forming apparatus according to claim 10,
wherein the front portion of the feeder image is formed by one of the plurality of developing members that accommodates a more consumed one of the different color toners.

12. The image forming apparatus according to claim 9,
wherein the rear portion of the feeder image includes an image formed with a less consumed one of the different color toners accommodated in one of the plurality of developing members.

13. The image forming apparatus according to claim 9,
wherein the front portion of the feeder image includes an image formed with a predetermined one of the different color toners that is less perceptible by a user.

14. The image forming apparatus according to claim 9,
wherein the front portion of the feeder image includes an image formed with a predetermined one of the different color toners that is easily cleanable.

* * * * *